US006265825B1

(12) United States Patent
Asano

(10) Patent No.: US 6,265,825 B1
(45) Date of Patent: Jul. 24, 2001

(54) PLASMA DISPLAY PANEL WITH AN UP-CONVERSION PHOSPHOR

(75) Inventor: Toshiaki Asano, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/252,892

(22) Filed: Feb. 19, 1999

(30) Foreign Application Priority Data

Feb. 27, 1998 (JP) ..... 10-061882

(51) Int. Cl.[7] ..... H01J 17/49
(52) U.S. Cl. ..... 313/582; 313/584; 313/46
(58) Field of Search ..... 313/582–587, 313/584, 456, 487; 345/99, 88, 60

(56) References Cited

U.S. PATENT DOCUMENTS

| | | | | |
|---|---|---|---|---|
| 3,659,136 | * | 4/1972 | Grodkiewicz | 313/501 |
| 3,838,307 | * | 9/1974 | Masi | 313/486 |
| 6,028,977 | * | 2/2000 | Newsome | 313/498 |
| 6,099,753 | * | 8/2000 | Yoshimura et al. | 313/582 |

FOREIGN PATENT DOCUMENTS

| | | |
|---|---|---|
| 0 622 765 | 11/1994 | (EP) . |
| 0 827 122 | 3/1998 | (EP) . |
| 2 154 347 | 9/1985 | (GB) . |
| 2 253 503 | 9/1992 | (GB) . |
| 49-089474 | 8/1974 | (JP) . |
| 49-091186 | 8/1974 | (JP) . |
| 63-142927 | 6/1988 | (JP) . |
| 7-297475 | 11/1995 | (JP) . |
| 9-054562 | 2/1997 | (JP) . |
| 9-545602 | 2/1997 | (JP) . |
| 9-086958 | 3/1997 | (JP) . |
| 10-050261 | 2/1998 | (JP) . |
| 10-149776 | 6/1998 | (JP) . |
| 10-15446 | 6/1998 | (JP) . |
| 11-073887 | 3/1999 | (JP) . |

* cited by examiner

*Primary Examiner*—Vip Patel
*Assistant Examiner*—Ken A Berck
(74) *Attorney, Agent, or Firm*—Sughrue, Mion, Zinn, Macpeak & Seas, PLLC

(57) ABSTRACT

The brightness of plasma display panel and extend the life thereof are improved. Of glass substrates 3 and 5 facing each other via partitioning walls 6 and defining a predetermined electric discharge space, a conventional phosphor layer 7 is provided on the glass substrate 5, and an up-conversion phosphor layer 8 is provided on the other glass substrate 3. Application of a high voltage between discharge electrodes 1 and 2 causes electric discharge, generating vacuum ultraviolet radiation and infrared radiation. The up-conversion phosphor layer 8 converts the infrared radiation to visible light, while the conventional phosphor layer 7 converts the vacuum ultraviolet radiation to visible light.

8 Claims, 2 Drawing Sheets

PLASMA DISPLAY PANEL WITH AN UP-CONVERSION PHOSPHOR

BACKGROUND OF THE INVENTION

The present invention relates to plasma display panels and, more particularly plasma display panels using phosphors for converting discharge light emission to visible light.

Recently, up-conversion phosphors have been developed as novel phosphor. As mentioned in Japanese Patent Laid-Open No. 7-297475, the up-conversion phosphor absorbs infrared radiation and emits visible light by converting the absorbed infrared rays. Presently, this phosphor is mainly applied to infrared laser detection. Japanese Patent Laid-Open No. 9-54562 also discloses a plasma display using up-conversion phosphor, which is irradiated by an infrared laser beam to produce display.

The structure and function of a usual plasma display panel will now be briefly described with reference to FIG. 4. FIG. 4 is a fragmentary schematic sectional view shown in the structure of a prior art plasma display panel of reflecting type. The illustrated plasma display panel comprises a glass substrate 3 with discharge electrodes 1 and 2 formed thereon, and a glass substrate 5 with a write electrode 4 formed thereon. These substrates 3 and 5 face each other via partitioning walls 6 defining spaces between them. The spaces are filled with discharge gas, for instance xenon (Xe) gas. A conventional phosphor layer 7 is formed between adjacent parallel partitioning walls 6 on the glass substrate 5. Each of the spaces is filled with a gas, for instance Xe, as discharge gas having a vacuum ultraviolet radiation zone. By applying a high voltage between the discharge electrodes 1 and 2, electric discharge is brought about between the electrodes 1 and 2 to generate vacuum ultraviolet radiation, which causes light emission form the conventional phosphopr layer 7 formed on the glass substrate 5.

The prior art plasma display panel has a problem that its brightness is low. This is so because the vacuum ultraviolet radiation for causing light emission from the conventional phosphor layer 7 is generated with low efficiency by the electric discharge in the Xe gas. Accordingly, when realizing a display with the prior art plasma display panel, the frequency of the discharge light emission is increased to obtain brightness that is necessary for the display. Increasing the discharge light emission frequency, however, has drawback that power consumption and heat generation are increased and reduce the life of the panel.

SUMMARY OF THE INVENTION

The invention was made in view of this background, and it has an object of providing a high brightness, long life plasma display panel, which can overcome the above drawback inherent in the prior art plasma display panel.

According to an aspect of the present invention, there is provided a plasma display panel comprising a pair of glass substrates facing each other via a predetermined electric discharge space, and a phosphor layer provided on at least one of the glass substrates, wherein the phosphor layer on at least one of the glass substrates contains up-conversion phosphor for converting infrared radiation to visible light.

According to another aspect of the present invention, there is provided a plasma display panel comprising a pair of glass substrates facing each other via a predetermined electric discharge space, and a phosphor layer provided on at least one of the glass substrates, wherein the phosphor layer has a structure obtained by alternately arranging a first layer of up-conversion phosphor for converting infrared radiation to visible light, and a second layer for converting ultraviolet radiation to visible light.

According to other aspect of the present invention, there is provided a plasma display panel comprising a pair of glass substrates facing each other via a predetermined electric discharge space, and a phosphor layer provided on at least one of the glass substrates, wherein a first layer of up-conversion phosphor for converting infrared radiation to visible light is formed on a dielectric layer formed on One of the glass substrate, and a second layer of phosphor for converting ultraviolet radiation to visible light is formed on the other glass substrate.

Other objects and features will be clarified from the following description with reference to attached drawings.

PREFERRED EMBODIMENTS OF THE INVENTION

Preferred embodiments of the present invention will now be described with reference to the drawings.

Figure 1:
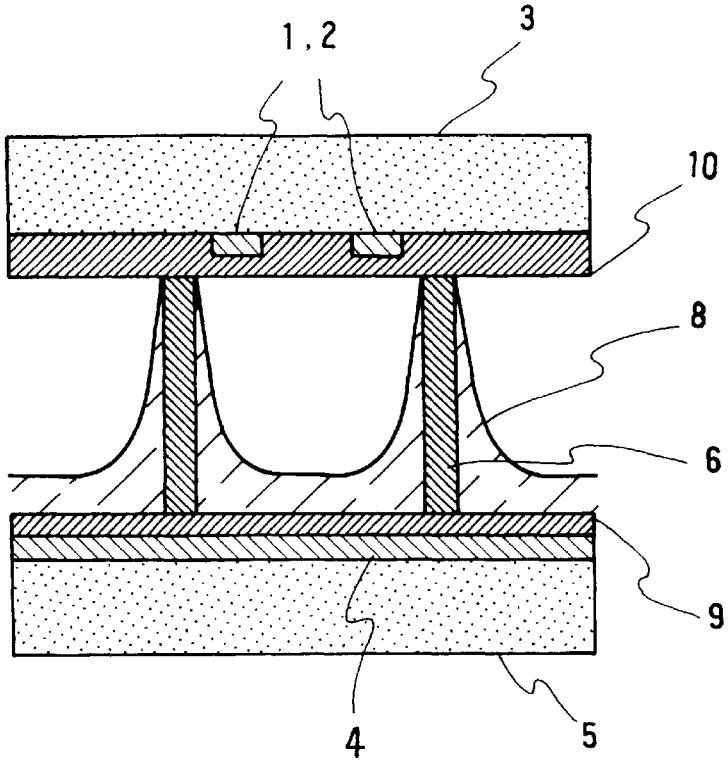
FIG. 1 is a fragmentary schematic sectional view showing a first embodiment of the plasma display panel according to the invention.

FIG. 1 is a fragmentary schematic sectional view showing a first embodiment of the plasma display panel according to the invention. The illustrated plasma display panel comprises a first glass substrate 3 with a discharge electrode formed thereon, partitioning walls 6 defining spaces between the substrates 3 and 5 faced each other. The spaces are filled with discharge gas, for instance xenon (Xe) gas. An up-conversion phosphor layer 8 is formed between adjacent parallel partitioning walls 6 on the second glass substrate 5.

A dielectric layer 9 is formed on the surface of the second glass substrate 5, and a dielectric layer 10 is formed on the surface of the first glass substrate 3.

In operation, application of a high voltage between the discharge electrodes 1 and 2 causes electric discharge therebetween, thus generating infrared radiation to cause light emission from the up-conversion phosphor layer 8 provided on the glass substrate 5. In the case of Xe discharge gas, for instance, an infrared radiation peak is obtained at nearly 850 nm. Thus, red light emission can be obtained by using an up-conversion phosphor having high light emission efficiency in this wavelength range, for instance alkali fluoride glass doped with praseodymium and ytterbium, as the up-conversion phosphor layer 8.

Figure 2:
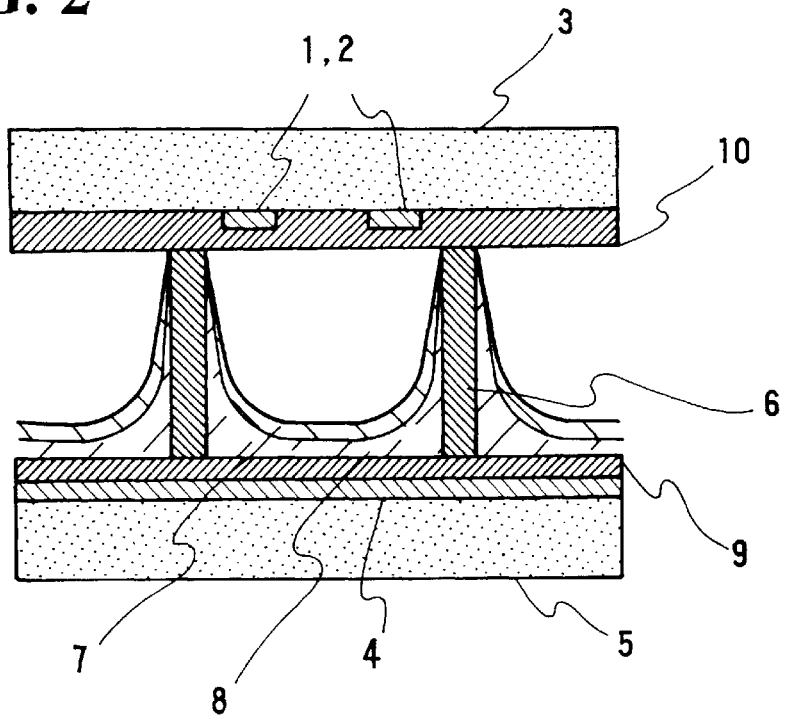
FIG. 2 is a fragmentary schematic sectional view showing a second embodiment of the plasma display panel according to the invention.

A second embodiment of the invention will now be described. FIG. 2 is a fragmentary schematic sectional view showing the second embodiment of the plasma display panel according to the invention. The illustrated plasma display panel comprises a glass substrate 3 with discharge electrodes 1 and 2 formed thereon, and a glass substrate 5 with a write electrode formed therein. These substrates 3 and 5 face each other via partitioning walls 6 defining space between the substrates 3 and 5. The spaces are filled with discharge gas, for instance xenon (Xe) gas. A conventional phosphor layer 7 and an up-conversion phosphor layer 8 are disposed alternately on the glass substrate 5 in the spaces defined by the glass substrates 3 and 5 and the partitioning walls 6.

Application of a high voltage between the discharge electrodes 1 and 2 causes electric discharge therebetween, thus simultaneously generating vacuum ultraviolet radiation and infrared radiation. The vacuum ultraviolet radiation causes light emission from the conventional phosphor layer 7, while at the same time infrared radiation having passed through the conventional phosphor layer 7 causes light emission of the up-conversion phosphor layer 7. The infrared radiation passes through the conventional phosphor layer 7 due to its high permeating power. The two emitted light beams are thus combined to provide bright light emission.

Figure 3:
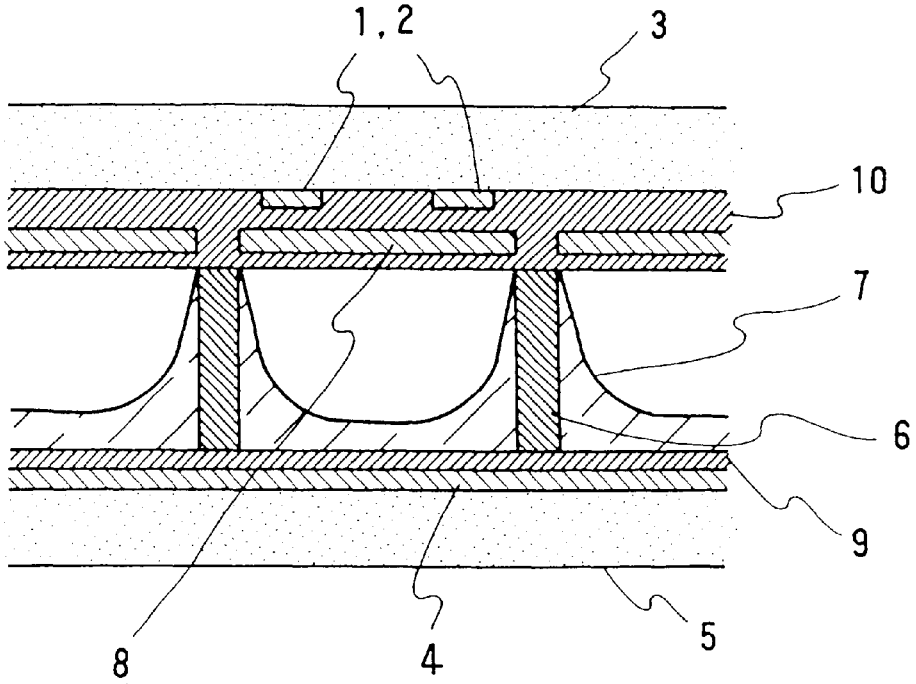
FIG. 3 is a fragmentary schematic sectional view showing the third embodiment of the plasma display panel according to the invention.
Figure 4:
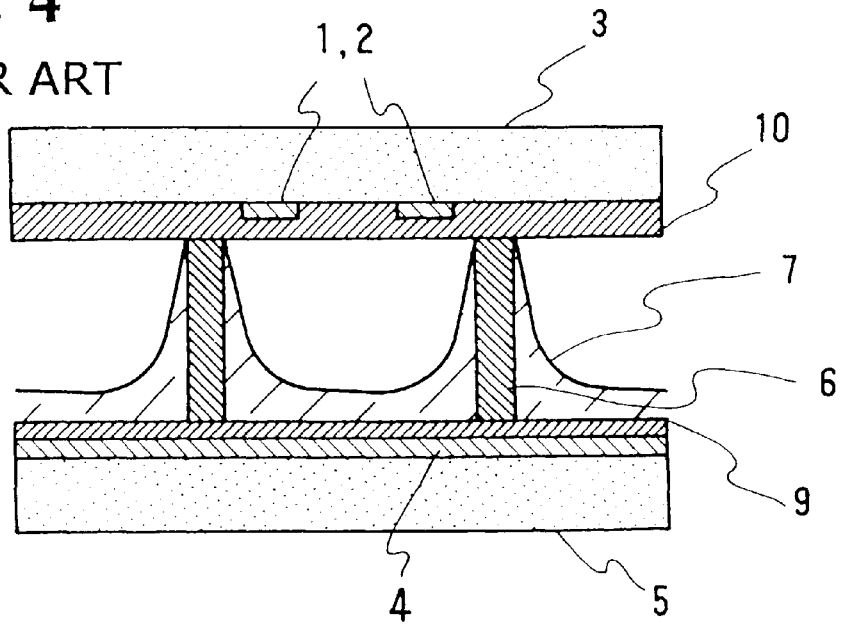
FIG. 4 PRIOR ART
FIG. 4 is a fragmentary schematic sectional view shown in the structure of a prior art plasma display panel of reflecting type.

A third embodiment of the invention will now be described. FIG. 3 is a fragmentary schematic sectional view showing the third embodiment of the plasma display panel according to the invention. The illustrated plasma display panel comprises a glass substrate 3 with discharge electrodes 1 and 2 formed thereon, and a glass substrate 5 with a write electrode 4 formed thereon. These substrates 3 and 5 face each other via partitioning walls 6 defining spaces between them. The spaces are filled with discharge gas, for instance xenon (Xe) gas. Also, in these spaces a conventional phosphor layer 7 is formed on the glass substrate 5, and an up-conversion phosphor layer 8 is formed on the glass substrate 3 via a dielectric layer 10.

Application of a high voltage between the discharge electrodes 1 and 2 causes electric discharge therebetween, thus simultaneously generating vacuum ultraviolet radiation and infrared radiation. The vacuum ultraviolet radiation causes light emission from the conventional phosphor layer 7, while at the same time the infrared radiation causes light emission from the up-conversion phosphor layer 8. Particularly, where the up-conversion phosphor layer 8 is formed by using up-conversion phosphor of glass character described before in connection with the first embodiment, light emitted from the conventional phosphor layer 7 almost entirely passes through the up-conversion phosphor layer 8. The brightness of the plasma display is thus the combination of the light emitted from the conventional phosphor layer 7 and light emitted from the up-conversion phosphor layer 8, and thus very bright light emission can be obtained. In addition, since the up-conversion phosphor layer 8 absorbs the infrared radiation component, it is possible to obtain a secondary effect that infrared radiation to the outside of the plasma display panel is reduced.

As described before, by converting high power infrared radiation generated by electric discharge to visible light with the up-conversion phosphor provided in the plasma display panel structure, it is possible to obtain light emission with a means different from a plasma display panel having the prior art structure. It is thus possible to utilize not only vacuum ultraviolet radiation but also infrared radiation, thus improving the light emission efficiency and extending the life of the plasma display.

In the plasma display panel according to the invention, the phosphor layer provided on at least either one of the two glass substrates contained up-conversion phosphor, and it is thus possible to utilize not only vacuum ultraviolet radiation but also infrared radiation, thus improving the light emission efficiency and extending the life of the plasma display panel.

Changes in construction will occur to those skilled in the art and various apparently different modifications and embodiments may be made without departing from the scope of the present invention. The matter set forth in the foregoing description and accompanying drawings is offered by way of illustration only. It is therefore intended that the foregoing description be regarded as illustrative rather than limiting.

What is claimed is:

1. A plasma display panel comprising a pair of glass substrates facing each other via a predetermined electric discharge space, and a phosphor layer provided on at least one of the glass substrates, wherein:

the phosphor layer has a structure obtained by alternately arranging a first layer of up-conversion phosphor for converting infrared radiation to visible light, and a second layer for converting ultraviolet radiation to visible light.

2. The plasma display panel according to claim 1, wherein the up-conversion phosphor is constituted by alkali fluoride glass doped with praseodymium and ytterbium.

3. The plasma display panel according to claim 1, wherein the electric discharge space is filled with Xe discharge gas.

4. A Plasma display panel comprising a pair of glass substrates facing each other via a predetermined electric discharge space, and a phosphor layer provided on at least one of the glass substrates, wherein:

a first layer of up-conversion phosphor for converting infrared radiation to visible light is formed on a dielectric layer formed on One of the glass substrate, and a second layer of phosphor for converting ultraviolet radiation to visible light is formed on the other glass substrate.

5. The plasma display panel according to claim 4, wherein the up-conversion phosphor is constituted by alkali fluoride glass doped with praseodymium and ytterbium.

6. The plasma display panel according to claim 4, wherein the electric discharge space is filled with Xe discharge gas.

7. A plasma display panel comprising:

a first glass substrate with a pair of discharge electrodes formed thereon;

a second glass substrate with a write electrode formed therein;

partitioning walls defining space between the first and second substrates, the spaces being filled with discharge gas;

a phosphor layer and an up-conversion phosphor layer, for converting infrared radiation to visible light, disposed alternately on the second glass substrate in the spaces defined by the first and second glass substrates and the partitioning walls.

8. A plasma display panel comprising:

a first glass substrate with a pair of discharge electrodes formed thereon;

a second glass substrate with a write electrode formed thereon;

partitioning walls defining spaces between the first and second glass substrates, the spaces being filled with discharge gas;

a phosphor layer formed on the second glass substrate; and an up-conversion phosphor layer, for converting infrared radiation to visible light, formed on the first glass substrate via a dielectric layer.

* * * * *